US005286024A

United States Patent [19]

Winblad

[11] Patent Number: 5,286,024

[45] Date of Patent: Feb. 15, 1994

[54] SYSTEM FOR SENSING THE POSITION OF A JOYSTICK

[75] Inventor: Wade O. Winblad, Hayward, Calif.

[73] Assignee: Atari Games Corporation, Milpitas, Calif.

[21] Appl. No.: 672,361

[22] Filed: Mar. 20, 1991

[51] Int. Cl.[5] ..... A63F 9/22

[52] U.S. Cl. ..... 273/148 B; 273/438; 338/128; 345/158

[58] Field of Search ..... 273/434, 438, 148 B, 273/DIG. 28; 340/706, 709; 338/128; 341/20

[56] References Cited

U.S. PATENT DOCUMENTS

| | | | |
|---|---|---|---|
| 3,178,600 | 4/1965 | Bers | 310/166 |
| 3,331,972 | 7/1967 | Moller | 338/428 |
| 3,643,148 | 2/1972 | Brown et al. | 318/628 |
| 4,051,401 | 9/1977 | Hayward | 310/216 |
| 4,156,130 | 5/1979 | Ivashin | 273/438 |
| 4,352,646 | 10/1982 | Laing et al. | 417/420 |
| 4,459,578 | 7/1984 | Sava et al. | 338/128 |
| 4,469,330 | 9/1984 | Asher | 273/148 B |
| 4,491,325 | 1/1985 | Bersheim | 273/148 B |
| 4,500,867 | 2/1985 | Ishitobi et al. | 338/128 |
| 4,520,355 | 5/1985 | Mitch | 273/438 |
| 4,533,899 | 8/1985 | Isaksson | 338/128 |
| 4,587,510 | 5/1986 | Kim | 338/128 |
| 4,661,737 | 4/1987 | Barri | 310/166 |
| 4,685,678 | 8/1987 | Frederiksen | 273/148 B |
| 4,689,449 | 8/1987 | Rosen | 338/128 |
| 4,707,642 | 11/1987 | Sorimachi et al. | 318/37 |
| 4,733,214 | 5/1988 | Andresen | 338/128 |
| 4,739,241 | 4/1988 | Vachtsevanos et al. | 318/800 |
| 4,825,157 | 4/1989 | Mikan | 324/208 |

FOREIGN PATENT DOCUMENTS

| | | | |
|---|---|---|---|
| 2704596 | 8/1978 | Fed. Rep. of Germany | 338/128 |
| 0003541 | 1/1984 | Japan | 340/709 |

OTHER PUBLICATIONS

Carmichael, M., "Joystick resolving mechanism", IBM Technical Disclosure Bulletin, vol. 21, No. 12, May 1979 pp. 5021, 5022, 5023, 5024.

*Primary Examiner*—Jessica J. Harrison

*Attorney, Agent, or Firm*—Knobbe, Martens, Olson & Bear

[57] ABSTRACT

A joystick position sensing device has a housing and a pivot ball movably mounted on said housing. The ball defines a prime axis, and a joystick is attached to the ball coaxially with the prime axis. The ball also defines two great circles which are orthogonal to each other and which intersect the prime axis. A groove is partially inscribed on the ball over a portion of each great circle, and a respective follower arm is slidably engaged with each groove. Also, each follower arm is rotatably engaged with a respective potentiometer. Motion of the joystick causes the ball (and grooves) to move, and the follower arms can slide in their grooves, or rotate relative to their potentiometers to adjust the setting of the associated potentiometer, in response to motion of the ball. The system generates a signal representative of the position of the joystick relative to the housing based upon the output signals of the potentiometers.

26 Claims, 4 Drawing Sheets

SYSTEM FOR SENSING THE POSITION OF A JOYSTICK

FIELD OF THE INVENTION

The present invention relates generally to remote control devices. More particularly, the present invention relates to devices for sensing the orientation of a joystick, and for generating a control signal in response to the sensed joystick position. The present invention particularly, though not exclusively, relates to systems and devices which sense and indicate the position of a joystick of a video game, for controlling the play of the game.

BACKGROUND OF THE TECHNOLOGY

A large number of applications exist for remote control devices. Indeed, remote control devices have become everyday tools with a plethora of uses. For example, many if not most households now own interactive video entertainment devices which present games that can be controlled by a user by remote means. Also, many flight simulators use remote-control devices for simulating the controls of an aircraft, e.g., a helicopter.

One common remote control device is the well-known joystick. To control a video display or other device with a joystick, a user manipulates the joystick relative to a fixed component, ordinarily the housing to which the joystick is pivotally attached. As the joystick is moved, its orientation relative to the housing is sensed. Based upon the sensed orientation of the joystick, a signal can be generated to control, for example, the position of a cursor on a video display.

Not surprisingly, several devices have been introduced for sensing the orientation of a joystick and generating a control signal in response. As one example, Fredericksen U.S. Pat. No. 4,685,678 discloses a position transducer system in which a pair of slugs are attached to and moved by a joystick. Each slug is magnetically coupled to an inductor and each inductor is associated with an oscillator for generating a signal representative of the position of the slug and, hence, the joystick. Additionally, Kim U.S. Pat. No. 4,587,510 discloses an analog joystick controller in which a joystick is attached to a ball that is supported in a housing. The ball is connected through a relatively complicated mechanical linkage to potentiometers for generating a signal representative of the position of the joystick.

Unfortunately, the devices discussed above have either complicated constructions (e.g., the Kim device) or require comparatively expensive electronics (e.g., the Fredericksen device). Thus, a need exists to provide a joystick position sensor which can accurately sense the position of a joystick, and which has a relatively simple and inexpensive construction. The present invention recognizes that such a joystick position sensing system can be provided.

Accordingly, it is an object of the present invention to provide a joystick position sensing device which can relatively accurately sense the position of a joystick. It is another object of the present invention to provide a joystick position sensing device that has a comparatively simple construction. Furthermore, it is an object of the present invention to provide a joystick position sensing device that is relatively cost-effective to manufacture and easy to use.

SUMMARY OF THE INVENTION

A system for sensing the position of a joystick has a housing which supports a substantially spherical pivot ball that is biased into a reference orientation relative to the housing. This pivot ball has a prime axis which moves with the ball and which defines a reference direction when the ball is in its reference orientation. The joystick is fixedly attached to the pivot ball coaxially with the prime axis of the ball. As envisioned by the present invention, the joystick can be used to control the position of a cursor on a video display. Alternatively, the joystick can be used to indicate the desired position of the control surfaces of an apparatus such as an aircraft.

In accordance with the present invention, the pivot ball is movably mounted in a socket that is formed in the housing. The ball is mounted in the socket for rotational motion of the ball about any axis of the ball that is perpendicular to the prime axis. Also, the pivot ball can be moved such that the prime axis of the ball precesses about its reference direction. In other words, the pivot ball is mounted on the housing for universal tilting movement of the ball.

As further envisioned by the present invention, the pivot ball is formed with two grooves, with each groove defining a portion of a great circle on the ball. The great circles which are defined by the grooves intersect the prime axis of the pivot ball and are orthogonal to each other. Stated differently, one great circle is separated from the other great circle by ninety (90) degrees, relative to the surface of the ball.

In a preferred embodiment of the present invention, a first follower arm is slidably engaged with one of the grooves of the pivot ball, and a second follower arm is slidably engaged with the other groove. Each follower arm is in turn rotatably coupled to a respective potentiometer, and the potentiometers are fixedly mounted on the housing. As the joystick is manipulated to move the pivot ball, each of the follower arms can slide in its groove, or rotate relative to its potentiometer, or both, in response to motion of the ball. Importantly, rotation of a follower arm changes the setting of the potentiometer which is associated with the particular arm.

More specifically, each follower arm can slide in its groove in response to motion of the pivot ball that has a component parallel to the plane of the great circle defined by the particular follower arm's groove. Moreover, the cooperation of structure between each follower arm and its associated groove causes the particular follower arm to rotate relative to its respective potentiometer in response to motion of the pivot ball that has a component perpendicular to the plane of the great circle defined by the follower arm's groove.

Each follower arm is mechanically coupled to its respective potentiometer, so that as the follower arm rotates, the follower arm adjusts the setting of its potentiometer. Consequently, the output signal of each potentiometer changes in response to rotation of its associated follower arm. In other words, the output signal of each potentiometer is representative of the orientation of the groove of the associated follower arm relative to the housing. Accordingly, as the skilled artisan will appreciate, the output signal of one potentiometer represents the orientation of the pivot ball (and, hence, the joystick) relative to a first dimension of the housing, e.g., the x-direction. Also, the output signal of the other potentiometer represents the orientation of the pivot ball (and, hence, the joystick) relative to a second dimension of the housing which is orthogonal to the first, e.g., the y-direction. Thus, the position of the joystick can be correlated to a position on a planar coordinate system. More particularly, a means for indicating the position of the joystick relative to the housing is electrically connected to each of the potentiometers. This indicating means can be any suitable device which can determine the orientation of the pivot ball (and, hence, the position of the joystick) based upon the signals generated by the potentiometers.

Additionally, to account for the varying distance between the grooves across the surface of the ball resulting from the ball's curvature, the present invention includes structure which permits one of the follower arms to translationally move relative to its associated potentiometer. Specifically, one follower arm has a cruciform shape, and is attached to its potentiometer through a coupling which permits both rotational motion and translational movement of the follower arm relative to the follower arm's potentiometer. More specifically, one leg of the cruciform-shaped follower arm extends into the groove on the pivot ball that is associated with the follower arm. The other leg of the follower arm, which is perpendicular to the first leg, extends into a channel that is formed on a disc. This disc can slide within the channel. The disc in turn is fixedly attached to the potentiometer which is associated with the follower arm.

Importantly, the disc is attached to the potentiometer with the channel of the disc perpendicular to the plane of the great circle defined by the groove of the follower arm. Consequently, the follower arm can slide "side-to-side" in the channel as the groove slides "up" and "down" the follower arm. This permits the follower arm to move translationally relative to the other follower arm as required to account for the varying distance between the two grooves across the surface of the ball.

Further details of the present invention, as to both the structure and operation of the invention, are disclosed below in reference to the drawings, in which like numerals correspond to like parts, and in which.

DESCRIPTION OF A PREFERRED EMBODIMENT

Figure 1:
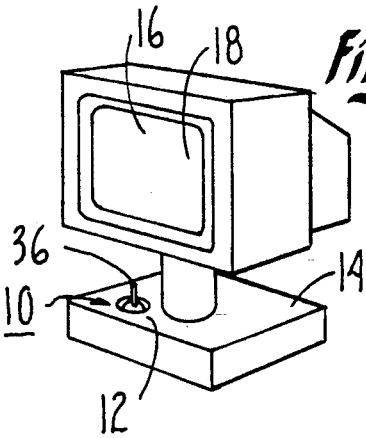
FIG. 1 is a perspective view of the novel joystick position sensing system of the present invention, in one intended environment.

Referring initially to FIG. 1, a joystick position sensing device is shown, generally designated 10. As shown, the device 10 is electrically connected to a portion 12 of a video display controller 14 for establishing the position of a cursor 16 on a video screen 18.

Figure 2:
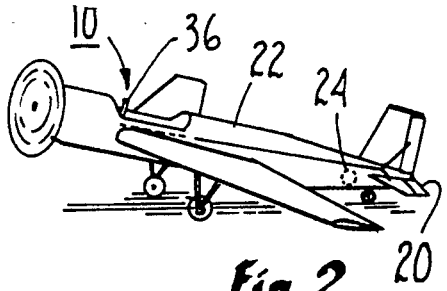
FIG. 2 is a perspective view of the novel joystick position sensing system of the present invention, in another intended environment.

While FIG. 1 shows that the device 10 can be used in conjunction with a video display apparatus, it is to be understood that the device 10 has a wide variety of other applications. For example, as shown in FIG. 2, the device 10 can be used to indicate the desired position of the control surfaces 20 of an aircraft 22. More specifically, the device 10 can be electrically connected to a motor 24 (shown in phantom in FIG. 2) which can establish the position of the control surfaces 20 in response to the electrical signal sent to the motor 24 from the device 10. Indeed, the device 10 can be used to sense the orientation of any ball relative to a reference frame. For example, the device 10 can be used to track the position of a spherical motor.

Figure 3A:
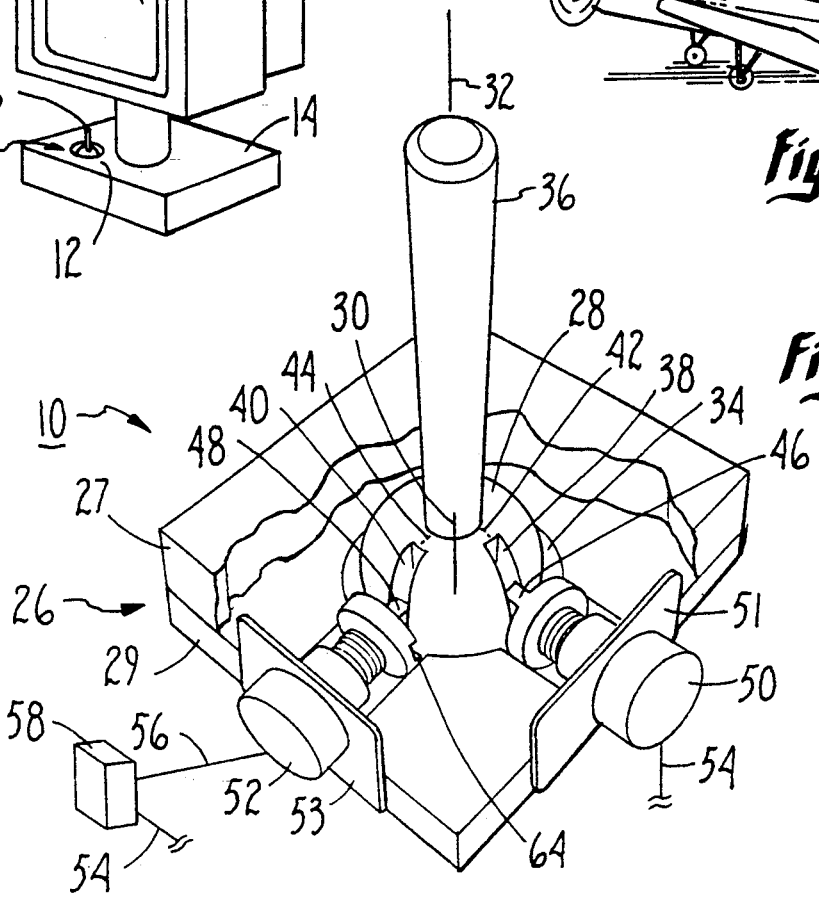
FIG. 3A is a perspective view of the novel joystick position sensing system of the present invention shown in the reference position, with portions of the housing cut away for clarity.
Figure 3B:
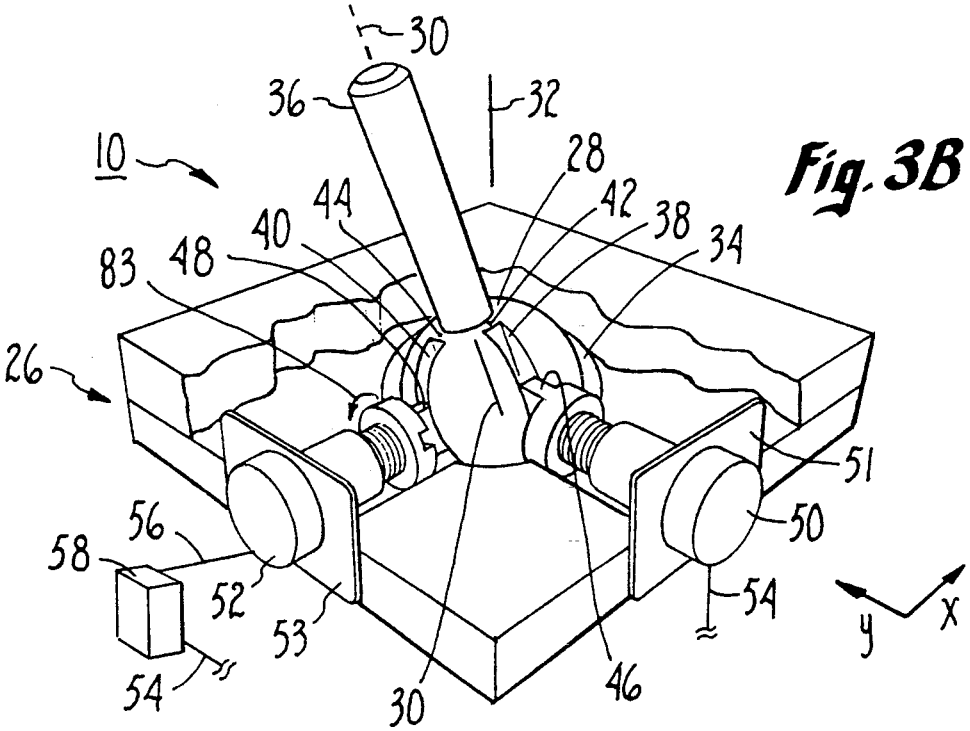
FIG. 3B is a perspective view of the novel joystick position sensing system of the present invention shown in a manipulated position, with portions of the housing cut away for clarity.
Figure 4:
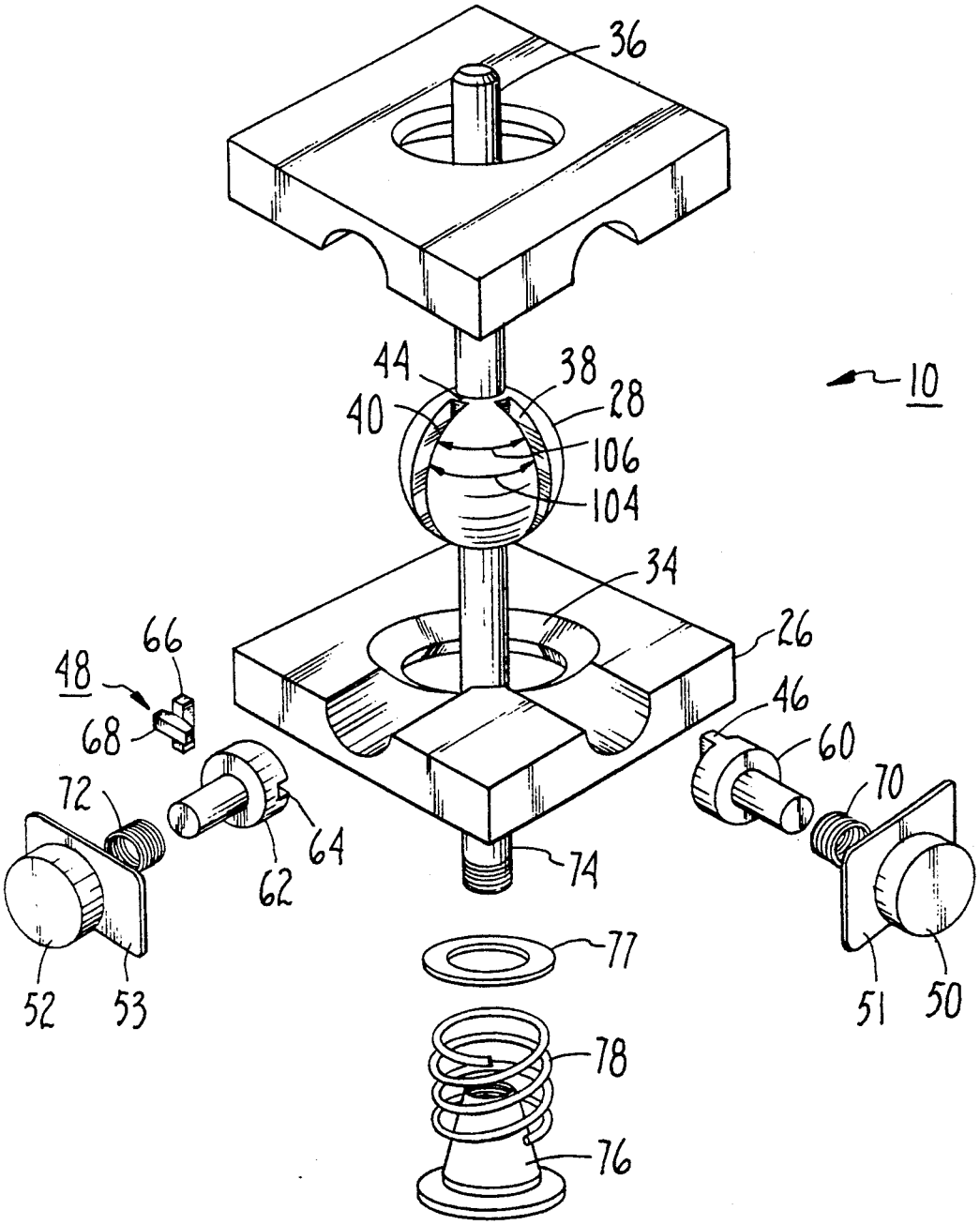
FIG. 4 is an exploded view of the novel joystick position sensing system of the present invention.

The details of the device 10 can best be seen in cross-reference to FIGS. 3A, 3B, and 4. As shown in FIG. 3A, the device 10 includes a housing 26 and a pivot ball 28 which is movably mounted in the housing 26. While FIG. 3A shows that the housing 26 can include an upper cover 27 and a lower case 29, it is to be understood that the housing 26 can be a single integrally molded housing (not shown). As shown in FIGS. 3A and 3B, the ball 28 defines a prime axis 30 which, when the ball 28 is in its biased position shown in FIG. 3A, establishes a reference direction, indicated by line 32.

In accordance with the present invention, the pivot ball 28 is mounted in a socket 34 which is formed in the housing 26 for rotation of the ball 28 about any axis of the ball 28 that lies in a plane that is perpendicular to the prime axis 30. Also, when the prime axis 30 is not parallel to the reference direction 32, the pivot ball 28 can be moved such that the prime axis 30 precesses about the reference direction 32. The ball 28 cannot, however, be rotated about the prime axis 30. Thus, the pivot ball 28 is mounted on the housing 26 for universal tilting movement of the ball 28 relative to the housing 26.

FIGS. 3A and 3B further show that a joystick 36 is attached to or formed integrally with the pivot ball 28 and extends outwardly from the pivot ball 28 coaxially with the prime axis 30. The joystick 36 and the pivot ball 28 are preferably made of a suitably strong, relatively lightweight material such as aluminum, steel, or other metal alloy. Alternatively, the pivot ball 28 and the joystick 36 can be made of hard plastic or composite material.

FIGS. 3A, 3B, and 4 show that two sensor paths, such as two grooves 38, 40 are formed on the surface of the pivot ball 28. The grooves 38, 40 can be inscribed into the pivot ball 28 or formed on the ball 28 during the manufacturing process. In any case, the grooves 38, 40 respectively establish portions of great circles 42, 44 on ball 28. As can be appreciated in reference to FIGS. 3A and 3B, each great circle 42, 44 intersects the prime axis 30 of the pivot ball 28. Also, the planes defined by the great circles are orthogonal to each other, i.e., the great circle 42 is spaced ninety (90) degrees from the great circle 44, relative to the prime axis 30.

Still referring to FIGS. 3A and 3B, the device 10 is shown to include two follower arms 46, 48. The first follower arm 46 is slidably engaged with the groove 38 and the second follower arm 48 is slidably engaged with the groove 40. Furthermore, the arms 46, 48 are elongated in the direction of their respective grooves. Consequently, the arms 46, 48 can slide longitudinally within their respective grooves, but cannot rotate relative to their respective grooves or slide in a direction transverse to their grooves.

As shown, each of the follower arms 46, 48 is rotatably engaged with a respective potentiometer 50, 52 for varying the output signal of the particular potentiometer in response to the orientation of the groove that is associated with the follower arm. More specifically, the follower arm 46 is engaged with a potentiometer 50 and the follower arm 48 is engaged with a potentiometer 52. The potentiometers 50, 52 are respectively attached to flanges 51, 53, and the flanges 51, 53 are in turn fixedly attached to the housing 26 by any means well-known in the art, e.g., bolting or welding.

FIGS. 3A and 3B show that the output signals of the potentiometers 50, 52 are conducted via lines electrical 54, 56 to a position indicator 58. Based upon the output signals of the potentiometers 50, 52, the position indicator 58 generates a signal which is representative of the position of the joystick 36, as more fully disclosed below. Position indicator 58 can be any well-known device which can generate a position signal based upon two input signals.

Now referring to FIG. 4 the first follower arm 46 is shown to include a mount, such as a disc 60 which connects the arm 46 to the potentiometer 50. As shown, the arm 46 is fixedly attached to the disc 60. Furthermore, the second follower arm 48 includes a mount, such as a disc 62, which connects the arm 48 to the potentiometer 52. Importantly, the second follower arm 48 is slidably engaged with a channel 64 that is formed in the disc 62. As shown, the disc 62 is positioned relative to the ball 28 such that the channel 64 is substantially perpendicular to the plane defined by the great circle 44. Also, the second follower arm 48 has a cruciform shape for engaging both the groove 40 and the channel 64. More particularly, the arm 48 includes two legs 66, 68 which are substantially orthogonal to each other. As shown in cross-reference to FIGS. 3A and 4, the leg 66 is slidably engaged with the groove 40, while the leg 68 is slidably engaged with the channel 64.

Referring back to FIGS. 3A and 3B, the device 10 is shown to optionally include biasing springs 70, 72 for establishing a reference position of the potentiometers 50, 52 and to eliminate the effects of hysterisis in the potentiometers 50, 52. More particularly, the spring 70 is positioned between the potentiometer 50 and the disc 60 of the follower arm 46 to bias the potentiometer 50 into a reference position when substantially no torque is applied to the potentiometer 50 by the follower arm 46. Also, the spring 72 is positioned between the potentiometer 52 and the disc 62 of the follower arm 48 to bias the potentiometer 52 into a reference position when substantially no torque is applied to the potentiometer 52 by the follower arm 48.

Finally, FIG. 4 shows that an extension 74 is fixedly attached to or formed integrally with the pivot ball 28. As shown, the extension 74 extends outwardly from the pivot ball 28 in a direction opposite to the joystick 36. The extension 74 is threadably engaged with or formed integrally with an abutment 76. A washer 77 and a righting spring 78 are positioned between the abutment 76 and the housing 26. Righting spring 78 urges the pivot ball 28 into its reference position, i.e., the position of the pivot ball 28 shown in FIG. 3A wherein the prime axis 30 is coaxial with the line 32.

Figure 5:
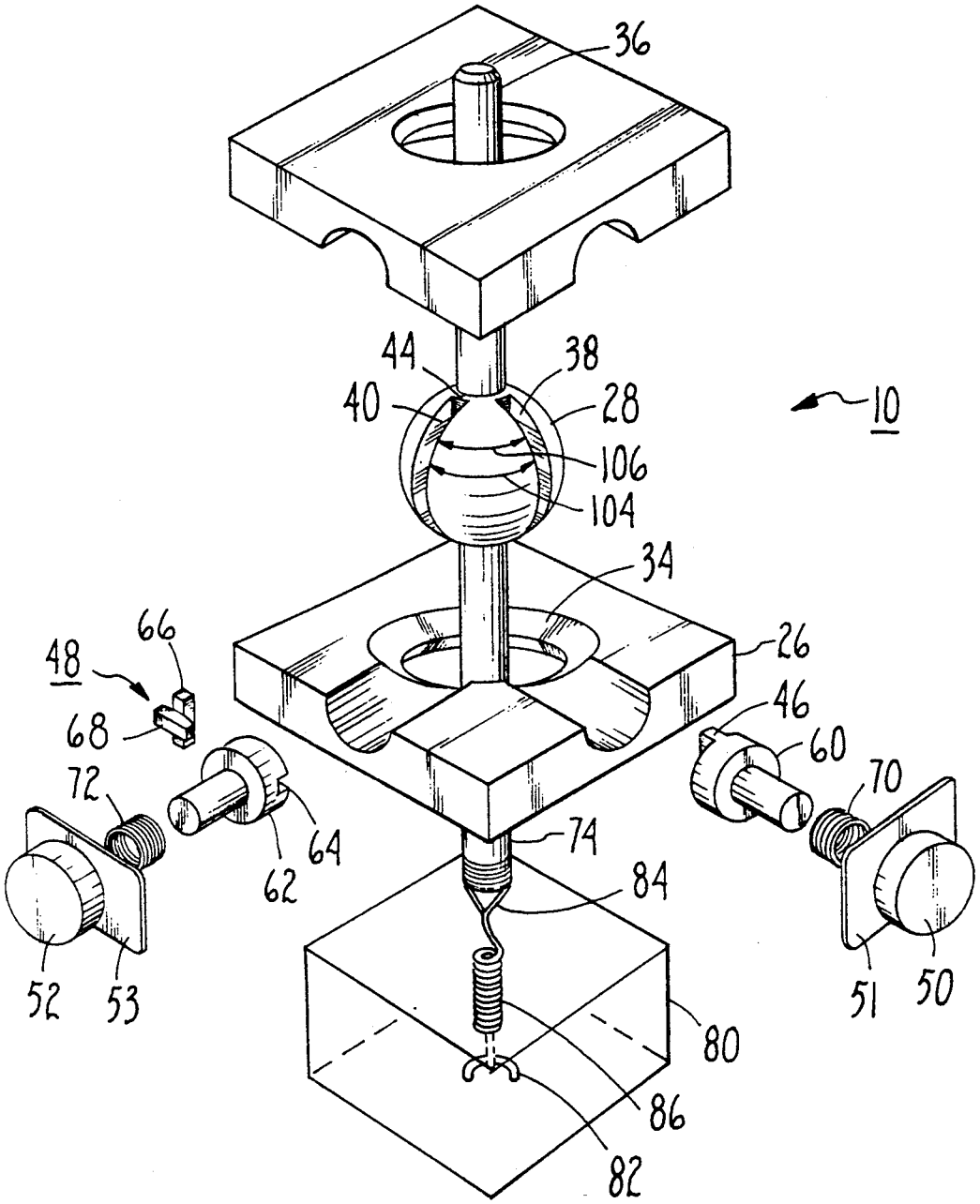
FIG. 5 is an exploded view of alternate embodiment of the novel joystick sensing system of the present invention with portions shown in phantom for clarity.

FIG. 5 shows that the pivot ball 28 can be urged into its reference position by an alternative structure to the spring 78. Specifically, a hollow frame 80 can be attached to the housing 26. The frame 80 includes eyes 82, 84 and a spring 86 is connected in tension to the eyes 82, 84 to bias the pivot ball into its reference position.

OPERATION

In operation, the device 10 is initially connected to an appropriate apparatus, e.g., the video display controller 14, to electrically conduct the signal from the position indicator 58 to the controller 14. The joystick 36 can then be manipulated to establish the position of the cursor 16 on the video screen 18.

Figure 6:
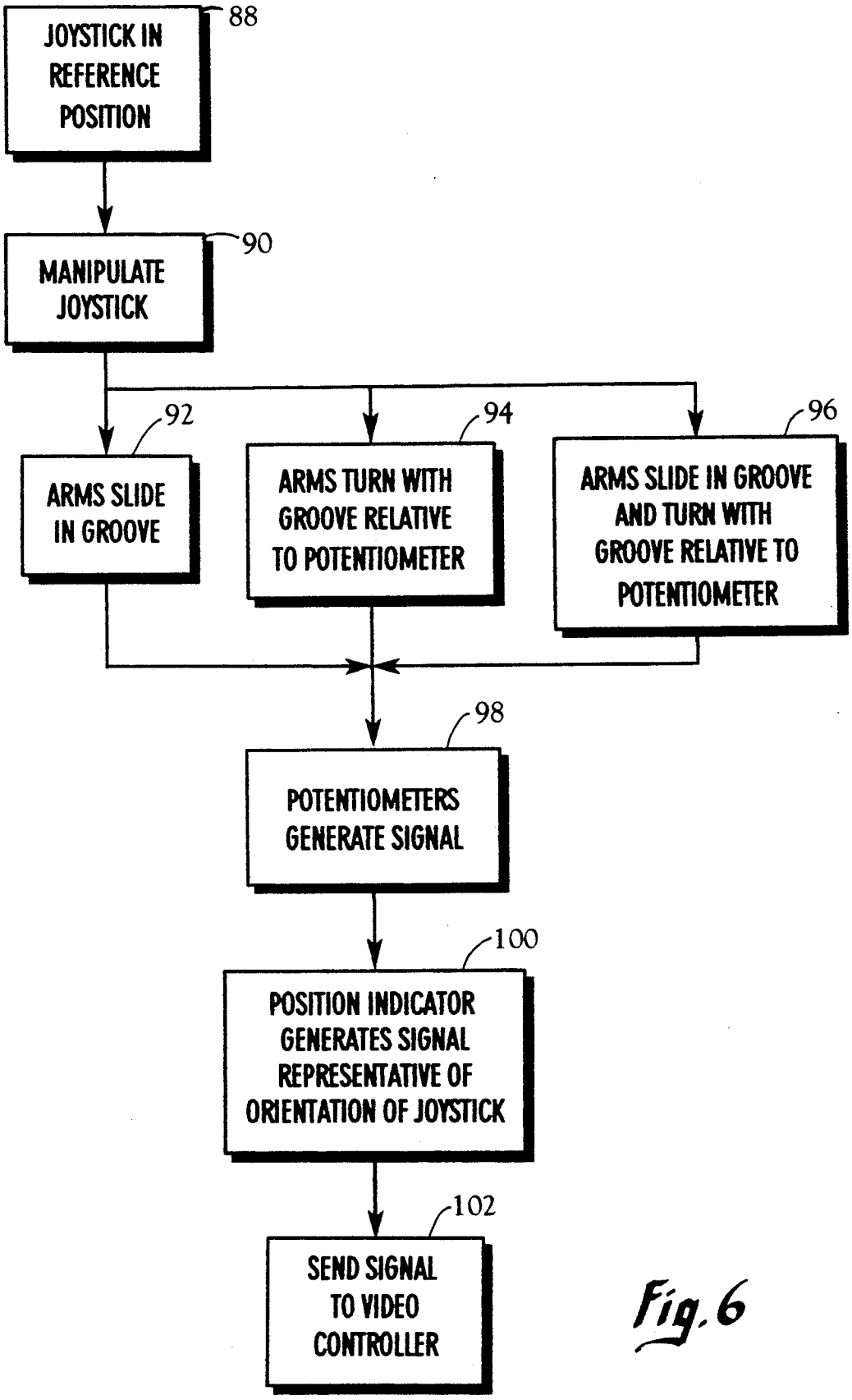
FIG. 6 is a block diagram of the logic of the novel joystick position sensing system of the present invention.

In order to describe the detailed operation of the device 10, reference is made to FIGS. 3A, 3B, and 6. As shown in FIG. 3A and indicated at block 88 in FIG. 6, the joystick 36 is initially in the reference position. As indicated at block 90, the joystick 36 can be manipulated into a position, e.g., the position shown in FIG. 3B, which is appropriate for the establishing the desired location of the cursor 16 on the video display 18.

When the joystick 36 is manipulated, the setting of one or both of the potentiometers 50, 52 is adjusted to adjust the respective output signal of the potentiometers 50, 52. More specifically, using the position of the joystick 36 shown in FIG. 3B as an example, when the joystick 36 is moved to the position shown in FIG. 3B, the follower arm 46 slides within the groove 38. In other words, the follower arm 46 slides within the groove 38 in response to turning motion of the pivot ball 28 that has a component (measured at the axis 30) which is parallel to the plane defined by the great circle 42, as indicated at block 92 of FIG. 6.

For the example shown in FIG. 3B, however, the motion of the ball 28 relative to its reference position does not have a component (measured at the axis 30) that is perpendicular to the plane defined by the great circle 42. Therefore, the follower arm 46 is not caused to rotate relative to the potentiometer 50. Thus, the setting of the potentiometer 50 does not change, indicating that the ball 28 has not moved in a direction that has a component perpendicular to the plane defined by the great circle 42.

On the other hand, as shown in FIG. 3B, the ball 28 has moved from its reference position in a direction which has a component that is perpendicular to the plane of the great circle 44. Consequently, the follower arm 46 is caused to rotate relative to the potentiometer 52, i.e., in the direction indicated by arrow 83, to change the resistive setting of the potentiometer 52. This step is indicated at block 94.

It will be appreciated by the skilled artisan that the output signal of the potentiometer 50, as represented at block 98, represents the position of the joystick 36 relative to one dimension of housing 26, e.g., the position of joystick 36 relative to the x-direction. It will be further appreciated that the output signal of the potentiometer 52, as indicated at block 98, represents the position of the joystick 36 relative to a dimension that is orthogonal to the dimension represented by the signal from the potentiometer 50. Stated differently, when the signal from the potentiometer 50 represents the position of the joystick 36 relative to the x-direction, the signal from the potentiometer 52 represents the position of the joystick 36 relative to the y-direction.

While the example above described the operation of the device 10 when the pivot ball 28 rotates about an axis that is perpendicular to the plane defined by the great circle 42, it is to be understood that the principles discussed above apply to all permitted motion of the pivot ball 28 within the housing 26. For instance, when the pivot ball 28 is moved to precess around the reference direction 32, the follower arms 46, 48 both slide within their respective grooves and rotate relative to their respective potentiometers., This step is represented at block 96 in FIG. 6.

As represented at block 98 in FIG. 6, the potentiometers 50, 52 generate electrical signals based upon the resistive settings of the potentiometers 50, 52 which are established by the follower arms 46, 48. Next, the signals from the potentiometers 50, 52 are sent to the position indicator 58. Position indicator 58, as indicated at block 100 of FIG. 6, generates a signal that is representative of the orientation (i.e., position) of the joystick 36 relative to the housing 26 in response to the signals from the potentiometers 50, 52.

Block 102 indicates that the signal from the position indicator 58 can be sent to the video display controller 14, shown in FIG. 1, to establish the position of the cursor 16 on the video display 18. Alternatively, the signal from the position indicator 58 can be sent to another appropriate control device, e.g., to the control surface motor 24 shown in FIG. 2.

As shown in FIG. 4, the distance between the grooves 38, 40 varies over the surface of the pivot ball 28. For example, the distance 104 between the grooves 38, 40 is greater than the distance 106 between the grooves 38, 40. The cooperation of structure between the channel 64 of the disc 62 and the leg 68 of the follower arm 48, however, accounts for this varying distance between the grooves 38, 40. More particularly, as the follower arm 48 slides within the groove 40 in response to motion of the ball 28, the arm 48 can also slide in the channel 64 to move toward or away from the groove 38, as appropriate to account for the variable distance between the grooves 38, 40.

While the discussion above fully and completely discloses a preferred embodiment of joystick position sensing device 10, it is to be understood that other structural embodiments and equivalents of device 10 fall within the spirit of the present invention, and that the only limitations on the scope of the present invention are those set forth in the appended claims.

What is claimed:

1. A joystick position sensing system, comprising:

a housing having first and second potentiometers mounted thereon;

a pivot ball movably mounted on said housing and defining a prime axis, said pivot ball being formed with first and second grooves, said grooves defining portions of respective first and second great circles each intersecting said prime axis, the plane of said first great circle being substantially orthogonal to the plane of said second great circle;

a joystick attached to said pivot ball and extending outwardly therefrom;

a first follower arm slidably engaged with said first groove and operatively engaged with said first potentiometer for generating a first signal representative of the orientation of said first groove relative to said housing;

a second follower arm slidably engaged with said second groove and operatively engaged with said second potentiometer for generating a second signal representative of the position of said second groove relative to said housing; and means electrically coupled to said first and second potentiometers for generating a third signal representative of the position of said joystick relative to said housing.

2. The system as recited in claim 1, further comprising a mount mechanically coupling said first follower arm to said first potentiometer, said mount having a channel formed thereon substantially perpendicularly to the plane defined by said first great circle and slidably engageable with said first follower arm for permitting translational movement of said first arm in said channel when said first arm slides within said first groove.

3. The system as recited in claim 2, wherein said mount is substantially disc-shaped.

4. The system as recited in claim 1, further comprising a video display having a cursor, said generating means being electrically connected to said video display for establishing the position of said cursor on said display in response to said third signal.

5. The system as recited in claim 1, further comprising a control surface and a motor mechanically coupled to said control surface for moving said control surface, said generating means being electrically connected to said motor to establish the position of said control surface in response to said third signal.

6. The system as recited in claim 1, wherein said pivot ball is movably mounted on said housing in a reference position and wherein said pivot ball is movable relative to said housing from said reference position.

7. The system as recited in claim 6, further comprising a means, positioned adjacent to said pivot ball, for urging said pivot ball into said reference position when said pivot ball has been moved relative to said housing away from said reference position.

8. A ball orientation sensor system, comprising:

a housing;

a pivot ball movably mounted in said housing;

a first and a second sensor path formed on said ball;

first signal means slidably engaged with said first sensor path and second signal means slidably engaged with said second sensor path for generating respective first and second signals representative of the positions of said first and second sensor paths relative to said housing; and position indicating means electrically connected to said first and second signal means for generating a third signal representative of the orientation of said pivot ball relative to said housing in response to said first and second signals.

9. A ball orientation sensor system, as recited in claim 8, wherein said sensor paths are grooves and wherein each of said signal means includes a follower arm slidably engaged with one of said grooves and a potentiometer rotatably engaged with said follower arm.

10. A ball orientation sensor system, as recited in claim 9, wherein each said potentiometer is mounted on said housing.

11. A ball orientation sensor system as recited in claim 10, wherein said pivot ball defines a prime axis, and said first and second grooves respectively define portions of first and second great circles on said ball, each said great circle intersecting said prime axis.

12. A ball orientation system as recited in claim 11, wherein said first signal means includes a mount mechanically coupling said first follower arm to said first potentiometer, said mount having a channel formed thereon substantially perpendicularly to the plane defined by said first great circle and slidably engageable with said first follower arm for permitting translational movement of said first arm in said channel when said first arm slides within said first groove.

13. A ball orientation system as recited in claim 12, wherein said mount is substantially disc-shaped.

14. A ball orientation sensor system as recited in claim 8, further comprising a video display having a cursor, said position indicating means being electrically connected to said video display for establishing the position of said cursor on said display in response to said third signal.

15. A ball orientation sensor system as recited in claim 8, further comprising a control surface and a motor mechanically coupled to said control surface for moving said control surface, said position indicating means being electrically connected to said motor to position said control surface in response to said third signal.

16. A ball orientation system as recited in claim 8, wherein said pivot ball is movably mounted on said housing in a reference position and wherein said pivot ball is movable relative to said housing from said reference position.

17. A ball orientation system as recited in claim 16, further comprising a means, positioned adjacent to said pivot ball, for urging said pivot ball into a reference position when said pivot ball has been moved relative to said housing away from said reference position.

18. A ball orientation sensor device, comprising:

a housing;

first signal means attached to said housing for generating a first electric signal, said first signal means including a first follower arm coupled to a first potentiometer for adjustably establishing said first signal;

second signal means attached to said housing for generating a second electrical signal, said second signal means including a second follower arm coupled to a second potentiometer for adjustably establishing said second signal;

a pivot ball movably mounted on said housing a first sensor path with said first follower arm slidably engaged in said first sensor path and a second sensor path with said second follower arm slidably engaged in said second sensor path, for generating said first and second signals as a function of the orientation of said pivot ball relative to said housing; and position indicating means electrically connected to said first and second signal means for generating a third signal representative of the orientation of said pivot ball relative to said housing in response to said first and second signals.

19. A ball orientation sensor device as recited in claim 18, wherein said first and second sensor paths in said pivot ball are formed by first and second grooves for respectively engaging said first and second follower arms.

20. A ball orientation sensor device as recited in claim 19, wherein said pivot ball defines a prime axis and each said groove defines a portion of a great circle relative to said ball, each said great circle intersecting said axis, one of said great circles being substantially orthogonal to the other said great circle.

21. A ball orientation sensor device as recited in claim 20, wherein each said potentiometer is mounted on said housing.

22. A ball orientation sensor device as recited in claim 20 wherein said first signal means includes a mount mechanically coupling said first follower arm to said first potentiometer, said mount having a channel formed thereon substantially perpendicularly to the plane established by the great circle defined by said first groove, said channel being slidably engageable with said first follower arm for permitting translational movement of said first arm in said channel when said first arm slides within said first groove.

23. A ball orientation sensor device as recited in claim 22, wherein said mount is substantially disc-shaped.

24. A ball orientation sensor system as recited in claim 18, wherein said pivot ball is movably mounted on said housing in a reference position and wherein said pivot ball is movable relative to said housing from said reference position.

25. A ball orientation sensor system as recited in claim 24, further comprising a means, positioned adjacent to said pivot ball, for urging said pivot ball into a reference position when said pivot ball has been moved relative to said housing away from said reference position.

26. A method for determining the orientation of a joystick relative to a joystick housing, comprising the steps of:

fixedly attaching a pivot ball to said joystick and movably mounting said pivot ball on said housing, said pivot ball having first and second grooves formed thereon;

slidably engaging a first follower arm with said first groove and a second follower arm with said second groove;

operatively engaging said first and second follower arms with respective first and second electronic signal generators;

generating first and second signals representative of the respective orientations of said first and second grooves relative to said housing; and electrically connecting a position indicator to said signal generators to generate a third signal representative of the orientation of said joystick relative to said housing in response to said first and second signals.

* * * * *